US008425836B1

(12) United States Patent
Bhowmik et al.

(10) Patent No.: US 8,425,836 B1
(45) Date of Patent: Apr. 23, 2013

(54) CHROMIUM ALLOY

(75) Inventors: Ayan Bhowmik, Cambridge (GB); Howard J. Stone, Cambrige (GB); Ian M. Edmonds, Derby (GB)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 13/297,560

(22) Filed: Nov. 16, 2011

(51) Int. Cl.
*C22C 27/06* (2006.01)

(52) U.S. Cl.
USPC ..... 420/428; 148/423

(58) Field of Classification Search ..... 420/428; 148/423
See application file for complete search history.

(56) References Cited

U.S. PATENT DOCUMENTS

| | | | | |
|---|---|---|---|---|
| 3,015,559 | A | 1/1962 | McGurty et al. | |
| 3,138,456 | A | 6/1964 | Edwards | |
| 3,779,006 | A * | 12/1973 | Lewis et al. | 60/39.11 |
| 3,841,847 | A | 10/1974 | Jones et al. | |
| 3,999,985 | A | 12/1976 | Jones et al. | |
| 5,282,907 | A | 2/1994 | Liu et al. | |
| 6,245,164 | B1 | 6/2001 | Liu et al. | |
| 2007/0003428 | A1 | 1/2007 | Gu et al. | |

OTHER PUBLICATIONS

Anstis, G.R. et al., "A Critical Evaluation of Indentation Techniques for Measuring Fracture Toughness: I, Direct Crack Measurements," *Journal of the American Ceramic Society*, Sep. 1981, pp. 533-538, vol. 64, No. 9.

Schneibel, J.H. et al., "Liquid-phase sintered iron aluminide-ceramic composites," *Intermetallics*, 1997, pp. 61-67, vol. 5.

Liu, C.T. et al., "Physical metallurgy and mechanical properties of transition-metal Laves phase alloys," *Intermetallics*, 2000, pp. 1119-1129, vol. 8.

Bhowmik, A. et al., "Microstructure and oxidation resistance of Cr-Ta-Si alloys," *University of Cambridge 2010 MRS Fall Meeting*, Nov. 29-Dec. 3, 2010.

Bhowmik, A. et al., "Microstructure and Oxidation Resistance of Cr-Ta-Si alloys," *Mater. Res. Soc. Symp. Proc.*, 2011, pp. 323-328, vol. 1295.

Brady, M.P. et al., "Oxidation resistance and mechanical properties of Laves phase reinforced Cr in-situ composites," *Intermetallics*, 2000, pp. 1111-1118, vol. 8.

Brady, M.P. et al., "Effects of Fe additions on the mechanical properties and oxidation behavior of $Cr_2Ta$ Laves phase reinforced Cr," *Scripta Materialia*, 2005, pp. 815-819, vol. 52.

Gu, Y.F. et al., "Chromium and Chromium-Based Alloys: Problems and Possibilities for High-Temperature Service," *JOM*, Sep. 2004, pp. 28-33.

Kumar, K.S. et al., "Structural Stability of the Laves phase $Cr_2Ta$ in a Two-Phase Cr-$Cr_2Ta$ Alloy," *Acta mater*, 2000, pp. 911-923, vol. 48.

Tien, R.H. et al., "Effect of Ru additions on microstructure and mechanical properties of Cr-$TaCr_2$ alloys," *Intermetallics*, 2005, pp. 361-366, vol. 13.

Kumar, K.S. et al., "Microstructural evolution and mechanical properties of a Cr-$Cr_2Hf$ alloy," *Intermetallics*, 1994, pp. 257-274, vol. 2.

Dimiduk, D.M. et al., "Mo-Si-B Alloys: Developing a Revolutionary Turbine-Engine Material," *MRS Bulletin*, Sep. 2003, pp. 639-645.

* cited by examiner

*Primary Examiner* — Jessee R. Roe
(74) *Attorney, Agent, or Firm* — Oliff & Berridge, PLC

(57) ABSTRACT

A hypereutectic chromium alloy consisting of 9 to 12 at % tantalum, 4 to 15 at % silicon, 0 to 7 at % molybdenum, 0 to 7 at % aluminum, 0 to 7 at % titanium, 0 to 5 at % rhenium, 0 to 2 at % silver, 0 to 2 at % hafnium, 0 to 2 at % lanthanum, 0 to 2 at % cerium, 0 to 2 at % yttrium and the balance chromium and incidental impurities. The hypereutectic chromium alloy has good oxidation resistance and good fracture toughness. The chromium alloy may be used to make gas turbine engine turbine blades, turbine vanes, turbine seals, combustion chamber tiles, exhaust nozzle segments or steam turbine components.

27 Claims, 3 Drawing Sheets

CHROMIUM ALLOY

BACKGROUND

The present invention relates to a chromium alloy and in particular to a chromium alloy for use at high temperatures, particularly for use as gas turbine engine components.

Currently gas turbine engine turbine blades and turbine vanes are manufactured from nickel based superalloys.

The use of chromium based alloys as alternative high temperature materials has also been suggested.

Chromium possesses a number of properties that are considered advantageous for high temperature applications. Chromium possesses a higher melting point than nickel, i.e. 1850° C. for chromium compared to 1450° C. for nickel, and exhibits reasonable oxidation resistance, lower density and lower cost than other elements that have similar or higher melting temperatures. However, chromium suffers from interstitial embrittlement, limited strength at high temperatures and deteriorating oxidation resistance above 1000° C.

U.S. Pat. No. 3,015,559 discloses a binary chromium alloy consisting of 0.5 to 6 wt % of a rare earth element selected from the group consisting of cerium, praseodymium, neodymium, samarium, gadolinium, dysprosium, holmium, erbium, thulium, ytterbium and lutetium.

U.S. Pat. No. 3,138,456 discloses a chromium alloy consisting of 0.5 to 7 wt % tantalum and 0.1 to 7 wt % of an element selected from the group consisting of titanium, vanadium, niobium, molybdenum, aluminium, silicon and mixtures thereof and the chromium content is not less than 85 wt %.

U.S. Pat. No. 3,841,847 discloses a chromium alloy consisting of at least 70 wt % chromium, up to 18 wt % yttrium, up to 18 wt % yttria, up to 5 wt % aluminium and up to 8 wt % silicon.

U.S. Pat. No. 6,245,164 discloses a chromium alloy consisting of up to 11 at % tantalum, up to 7 at % molybdenum and minor amounts of titanium, silicon, germanium, cerium, lanthanum, yttrium and other rare earth elements. This chromium alloy has a dual phase microstructure consisting of a Cr (Ta) solid solution and a $Cr_2Ta$ Laves phase. U.S. Pat. No. 6,245,164 states that hypoeutectic alloys which have a presence of tantalum in amounts not exceeding the eutectic composition show remarkable hardness and hypereutectic alloys which have the presence of tantalum above the eutectic composition become brittle and lose their impact resistance. U.S. Pat. No. 6,245,164 also states that the addition of silicon lowers the isothermal rate of oxidation but results in a greatly increased tendency to spall under thermal cycling conditions and at temperatures over 1000° C. the silicon reduces the oxidation resistance and causes spalling. U.S. Pat. No. 6,245,164 discloses that a specific chromium alloy consisting of 8.0 at % tantalum, 5.0 at % molybdenum, 3.0 at % silicon, 0.25 at % germanium, 0.2 at % lanthanum and the balance chromium has very good oxidation resistance at 1100° C.

SUMMARY

Accordingly the present invention seeks to provide a novel chromium alloy which has improved performance over the above mentioned chromium alloys.

Accordingly the present invention provides a hypereutectic chromium alloy consisting of 9 to 12 at % tantalum, 4 to 15 at % silicon, 0 to 7 at % molybdenum, 0 to 7 at % aluminium, 0 to 7 at % titanium, 0 to 5 at % rhenium, 0 to 2 at % silver, 0 to 2 at % hafnium, 0 to 2 at % lanthanum, 0 to 2 at % cerium, 0 to 2 at % yttrium and the balance chromium and incidental impurities.

The chromium alloy may consist of 9 to 11 at % tantalum. The chromium alloy may consist of 5 to 12 at % silicon. The chromium alloy may consist of 0 to 5 at % molybdenum. The chromium alloy may consist of 0 to 3 at % rhenium. The chromium alloy may consist of 0 to 1 at % silver. The chromium alloy may consist of 0 to 5 at % molybdenum, 0 to 5 at % aluminium and 0 to 5 at % titanium. The chromium alloy may consist of 5 to 10 at % silicon. The chromium alloy may consist of 0 to 1 at % rhenium. The chromium alloy may consist of 0 to lark hafnium. The chromium alloy may consist of 0 to 1 at % lanthanum, 0 to 1 at % cerium and 0 to 1 at % yttrium. The chromium alloy may consist of 0 to 1 at % lanthanum, 0 to 1 at % cerium and 0.1 to 1 at % yttrium.

The chromium alloy may consist of 1 to 6 at % molybdenum, preferably 2 to 4 at % molybdenum. The chromium alloy may consist of 1 to 6 at % aluminium, preferably 2 to 4 at % aluminium. The chromium alloy may consist of 1 to 6 at % titanium, preferably 2 to 6 at % titanium. The chromium alloy may consist of 1 to 5 at % rhenium, preferably 2 to 4 at % rhenium. The chromium alloy may consist of 0.1 to lark silver, preferably 0.5 at % silver. The chromium alloy may consist of 0.1 to 1.5 at % hafnium, preferably 1.0 at % hafnium. The chromium alloy may consist of 0.1 to 1.5 at % yttrium, preferably 0.5 at % yttrium.

The present invention also provides a hypereutectic chromium alloy consisting of 9 to 11 at % tantalum, 5 to 12 at % silicon, 0 to 5 at % molybdenum, 0 to 5 at % aluminium, 0 to 5 at % titanium, 0 to 3 at % rhenium, 0 to 1 at % silver, 0 to 2 at % hafnium, 0 to 1 at % lanthanum, 0 to 1 at % cerium, 0 to 1 at % yttrium and the balance chromium and incidental impurities.

The present invention also provides a hypereutectic chromium alloy consisting of 9 to 11 at % tantalum, 5 to 10 at % silicon, 0 to 5 at % molybdenum, 0 to 5 at % aluminium, 0 to 5 at % titanium, 0 to 1 at % rhenium, 0 to 1 at % silver, 0 to 1 at % hafnium, 0 to 1 at % lanthanum, 0 to 1 at % cerium, 0.1 to 1 at % yttrium and the balance chromium and incidental impurities.

The chromium alloy may comprise a Cr (Ta) solid solution and a $Cr_2Ta$ Laves phase. The chromium alloy may comprise a Cr (Ta) solid solution, a $Cr_2Ta$ Laves phase and a $Cr_3Si$ phase.

The chromium alloy may be used in a gas turbine engine component and the gas turbine engine component may be a turbine blade, a turbine vane, a turbine seal segment, a turbine shroud, a combustion chamber liner, a combustion chamber tile or an exhaust nozzle segment. The chromium alloy may be used in a steam turbine component, a thruster nozzle or a rocket component.

BRIEF DESCRIPTION OF THE DRAWINGS

The present invention will be more fully described with reference to the accompanying drawings, in which:—

DETAILED DESCRIPTION OF EXEMPLARY EMBODIMENTS

Figure 1:
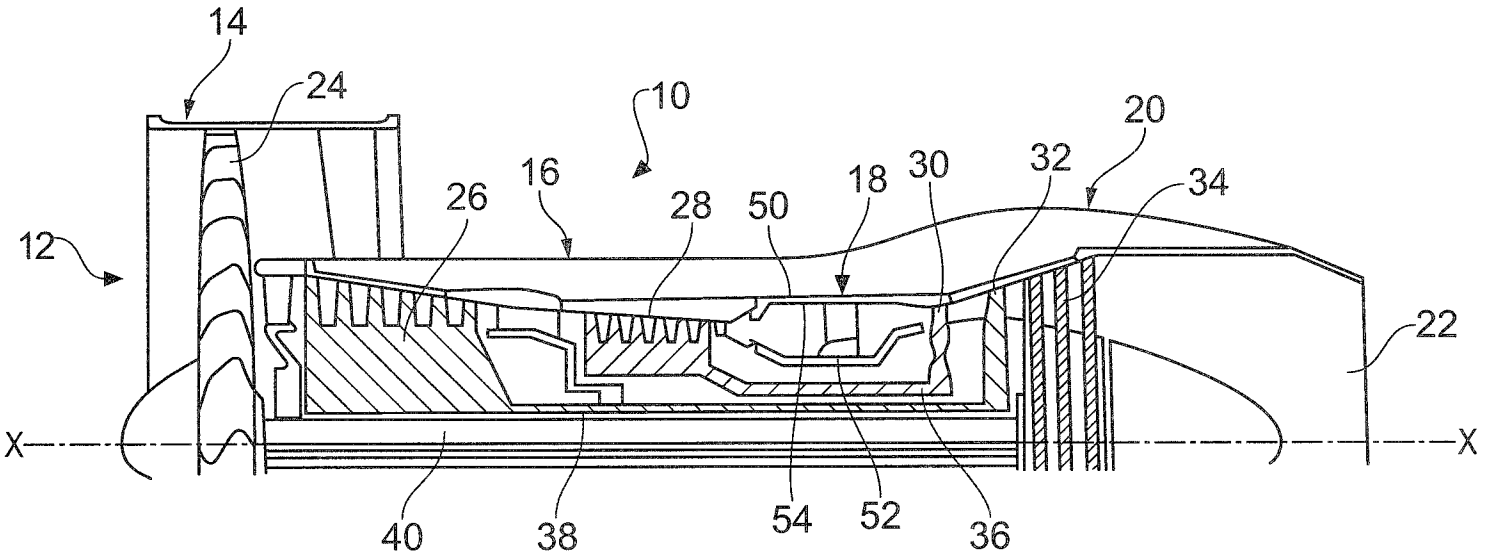
FIG. 1 is a cross-sectional view through a turbofan gas turbine engine having a component comprising a chromium alloy according to the present invention.

A turbofan gas turbine engine 10, as shown in FIG. 1, comprises in flow series an inlet 12, a fan section 14, a compressor section 16, a combustion section 18, a turbine section 20 and an exhaust 22. The fan section 14 comprises a fan 24. The compressor section 16 comprises in flow series an intermediate pressure compressor 26 and a high pressure compressor 28. The turbine section 20 comprises in flow series a high pressure turbine 30, an intermediate pressure turbine 32 and a low pressure turbine 34. The fan 24 is driven by the low pressure turbine 34 via a shaft 40. The intermediate pressure compressor 26 is driven by the intermediate pressure turbine 32 via a shaft 38 and the high pressure compressor 28 is driven by the high pressure turbine 30 via a shaft 36. The turbofan gas turbine engine 10 operates quite conventionally and its operation will not be discussed further. The turbofan gas turbine engine 10 has a rotational axis X.

Figure 2:
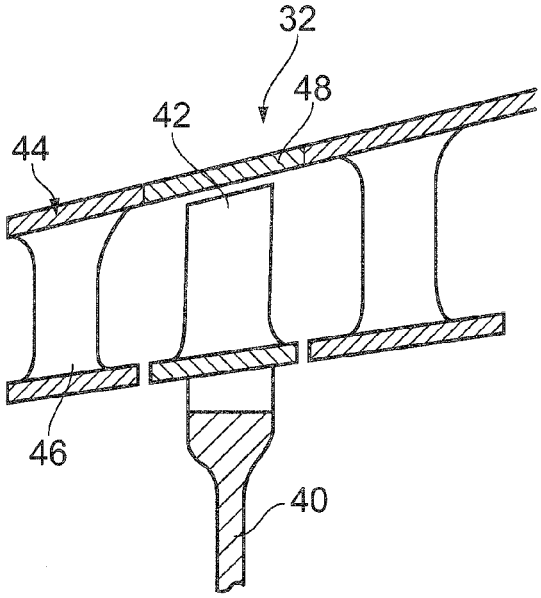
FIG. 2 is an enlarged cross-sectional view through the intermediate pressure turbine shown in FIG. 1 showing a turbine blade, a turbine vane and a turbine shroud comprising a chromium alloy according to the present invention.

FIG. 2 shows the intermediate pressure turbine 32 of FIG. 1. The intermediate pressure turbine 32 comprises an intermediate pressure rotor 40 having a single stage of intermediate pressure turbine blades 42 and an intermediate pressure stator 44 having a single stage of intermediate pressure turbine vanes 46. The intermediate pressure turbine blades 42 are circumferentially spaced around the intermediate pressure turbine rotor 40. The intermediate pressure turbine blades 42 are secured to and extend radially outwardly from the intermediate pressure rotor 40. The intermediate pressure turbine vanes 46 are circumferentially spaced around the intermediate pressure stator 44. The intermediate pressure turbine vanes 46 are secured to and extend radially inwardly from the intermediate pressure stator 44. The intermediate pressure stator 44 also comprises a plurality of intermediate pressure turbine seal segments 48. The intermediate pressure turbine seal segments 48 are positioned around, and spaced radially from, the tips of the intermediate pressure turbine blades 42. The intermediate pressure turbine blades, 44, the intermediate pressure turbine vanes 46 and the intermediate pressure turbine seal segments 48 consist of a chromium alloy according to the present invention. The turbine blade, 42, the turbine vanes 46 and the turbine seal segments 48 may be castings of the chromium alloy.

Figure 3:
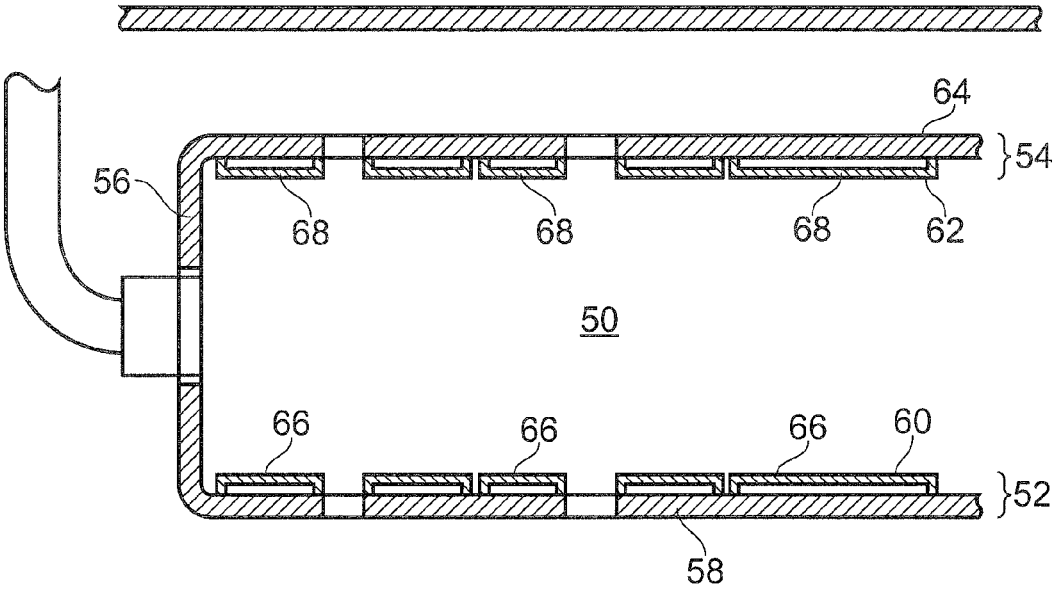
FIG. 3 is an enlarged cross-sectional view through the combustion chamber shown in figure showing a tile comprising a chromium alloy according to the present invention.

FIG. 3 shows the combustion section 18 of FIG. 1. The combustion section 18 comprises an annular combustion chamber 50 comprising a radially inner annular wall 52, a radially outer annular wall 54 and an upstream end wall 56 connecting the upstream ends of the radially inner annular wall 52 and the radially outer annular wall 54. The radially inner annular wall 52 is a double skin annular wall and the radially outer annular wall 54 is a double skin annular wall. The radially inner annular wall 52 comprises a radially inner wall 58 and a radially outer wall 60 and the radially outer annular wall 54 comprises a radially inner wall 62 and a radially outer wall 64. The radially outer wall 60 of the radially inner annular wall 52 comprises a plurality of tiles 66 and the radially inner wall 62 of the radially outer annular wall 54 comprises a plurality of tiles 68. The tiles 66 and 68 comprise a chromium alloy according to the present invention. The tiles 66 and 68 may be castings of the chromium alloy.

The present invention comprises a hypereutectic chromium alloy consisting of 9 to 12 at % tantalum, 4 to 15 at % silicon, 0 to 7 at % molybdenum, 0 to 7 at % aluminium, 0 to 7 at % titanium, 0 to 5 at % rhenium, 0 to 2 at % silver, 0 to 2 at % hafnium, 0 to 2 at % lanthanum, 0 to 2 at % cerium, 0 to 2 at % yttrium and the balance chromium and incidental impurities.

The present invention comprises a hypereutectic chromium alloy based on a microstructure comprising primarily a Cr (Ta) solid solution and a $Cr_2Ta$ Laves phase. The hypereutectic chromium alloy may also comprise other minority phases, for example $Cr_3Si$. This microstructure has the potential for use at high temperatures, for example in a gas turbine engine. The chromium rich phase, Cr (Ta), confers oxidation resistance and toughness on the chromium alloy while the Laves, $Cr_2Ta$ or tantalum dichromide, phase provides high temperature strength and creep resistance. The chromium based alloys of the present invention have the potential to have lower density than nickel based alloys.

TABLE 1

| | Element at % (range of deviation from average composition) | | | | |
|---|---|---|---|---|---|
| Alloy | Cr | Ta | Mo | Al | Si |
| Mo6 | 84.7(1.5) | 9.5(0.8) | 5.8(0.6) | | |
| Mo13 | 78.0(0.8) | 8.9(1.0) | 13.0(0.3) | | |
| Al4 | 86.2(0.6) | 9.4(0.5) | | 4.4(0.2) | |
| Al9 | 83.0(0.5) | 8.3(0.4) | | 8.6(0.2) | |
| Si1 | 86.8(0.7) | 9.2(0.6) | | | 4.0(0.5) |
| Si3 | 85.3(0.4) | 9.7(0.3) | | | 4.9(0.7) |
| Si5 | 85.9(0.7) | 9.4(0.7) | | | 4.7(0.2) |
| Si7 | 83.6(0.3) | 9.1(0.8) | | | 6.3(0.6) |
| Si10 | 79.6(1.0) | 10.6(0.9) | | | 9.8(0.5) |
| Si15 | 77.4(0.5) | 9.1(0.6) | | | 12.7(0.9) |

Additions of molybdenum, aluminium or silicon were made to a chromium-tantalum alloy with a dual phase microstructure of Cr (Ta) phase and $Cr_2Ta$ Laves phase. A series of chromium alloys with compositions given in Table 1 were prepared by vacuum arc melting from pure raw elements. The chromium alloys were re-melted at least four times to ensure chemical homogeneity. All the chromium alloys were annealed for 72 hours at a temperature of 1000° C. to reduce casting induced residual stresses and micro-segregation. The microstructures of the chromium alloys were characterised using scanning electron microscopy. Alloys Mo13 and Al9 were determined to have a hypoeutectic microstructure with Cr-solid solution dendrites. In contrast, the other chromium alloys exhibited a hypereutectic microstructure with Laves phase dendrites.

Figure 4:
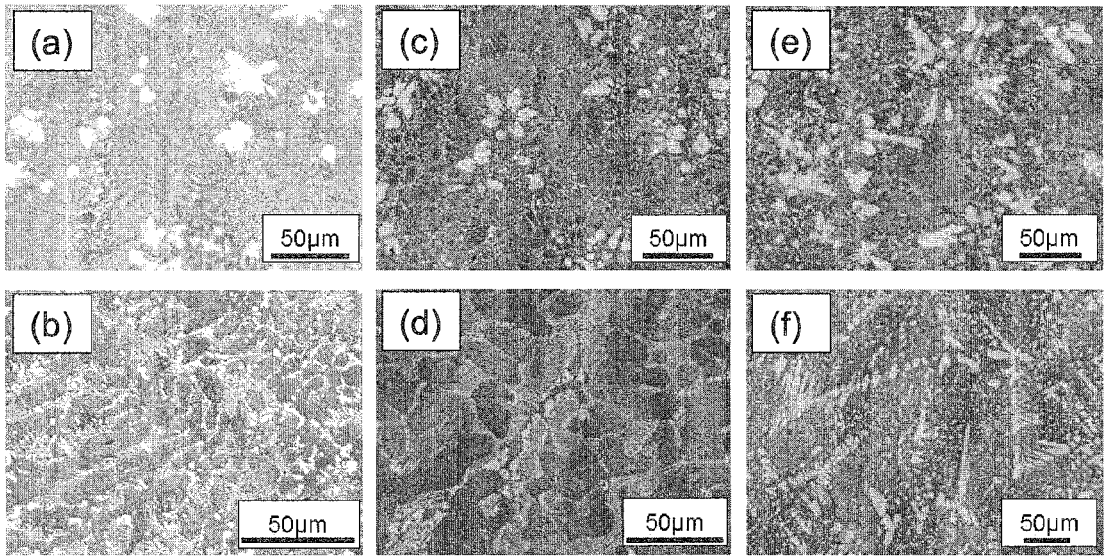
FIGS. 4*a* to 4*d* are back scattered microstructures of four chromium alloys tested, but which are not chromium alloys according to the present invention.
FIGS. 4*e* and 4*f* are back scattered microstructures of two chromium alloys tested and which are chromium alloys according to the present invention.

Examples of the microstructures observed in the bulk of the chromium alloys are shown in FIGS. 4*a* to 4*f*. FIG. 4*a* shows the back scattered microstructure of alloy Mo6, FIG. 4*b* shows the back scattered microstructure of alloy Mo13, FIG. 4*c* shows the back scattered microstructure of alloy Al4 and FIG. 4*d* shows the back scattered microstructure of alloy Al9, all of which are not chromium alloys of the present invention. FIG. 4*e* shows the back scattered microstructure of alloy Si5 and FIG. 4*f* shows the back scattered microstructure of alloy Si10, both of which are chromium alloys of the present invention.

TABLE 2

| Alloy | Hardness (HVN) |
|---|---|
| Mo6 | 642.3 (+/− 43A) |
| Mo13 | 650.8 (+/− 18.7) |
| Al4 | 501 (+/− 33.1) |
| Al9 | 515.3 (+/− 12.3) |
| Si1 | 393.7 (+/− 17.1) |
| Si3 | 389.0 (+/− 9.6) |
| Si5 | 446.8 (+/− 33.7) |
| Si7 | 461.5 (+/− 32.2) |
| Si10 | 611.7 (+/− 20.4) |
| Si15 | 901.1 (+/− 37.3) |

To test the mechanical properties of the chromium alloys a combination of micro-hardness tests and fracture toughness tests were performed. Micro-hardness measurements were made on all the chromium alloys. In addition the extent of cracking around the indent corners, where it was observed, was interpreted to give a measure of the fracture toughness of the chromium alloys, in accordance with the method proposed by G R Anstis, P Chantikul, B R Lawn, D B Marshall, Journal of the American Ceramic Society 64 (1981) 533-538. For the silicon containing chromium alloys no cracking was observed during indentation. As a result, the fracture toughness of the Si5 and Si10 alloys were obtained from three-point bend tests following the methodology described by J H Schneibel, C A Carmichael E D Specht, R Subramanian, Intermetallics 5 (1997) 61-67. The overall hardness of all the chromium alloys is shown in Table 2.

With the exceptions of alloys Si1 and Si3, the chromium alloys exhibited greater hardness than that of a binary Cr-10 at % alloy which has a hardness of 425 (HVN). It is seen from Table 2 that the extent of hardening increases with increasing amounts of the alloying element. These results are consistent with increased solid solution strengthening in these chromium alloys and/or increased volume fraction of the Laves phase in these chromium alloys.

TABLE 3

| Alloy | Fracture Toughness (MPaqm) |
|---|---|
| Mo6 | 5.4 (+/− 0.1) |
| Mo13 | 7.7 (+/− 0.1) |
| Al4 | 8.8 (+/− 0.1) |
| Al9 | 4.5 (+/− 0.1) |
| Si5 | 18.4 (+/− 0.5) |
| Si10 | 15.2 (+/− 4.9) |

The fracture toughnesses of the chromium alloys are shown in Table 3. As mentioned above, the hardness measurements for the molybdenum and aluminium containing chromium alloys were obtained by the indentation method. It is seen that the fracture toughness of the molybdenum containing chromium alloys increases with increasing amounts of the alloying element. The additions of aluminium showed a deleterious effect on fracture toughness with reduced fracture toughness with increased aluminium content, e.g. comparing alloy Al4 and Al9. The silicon containing chromium alloys showed no evidence of cracking following the indentation hardness measurements. The fracture toughness of the silicon containing chromium alloys was determined by three-point bending tests and it is seen that the fracture toughness of the silicon containing chromium alloys are considerably greater than the molybdenum and aluminium containing chromium alloys. The chromium alloy with the greatest fracture toughness is alloy Si5 at 18.4 MPa√m.

Figure 5:
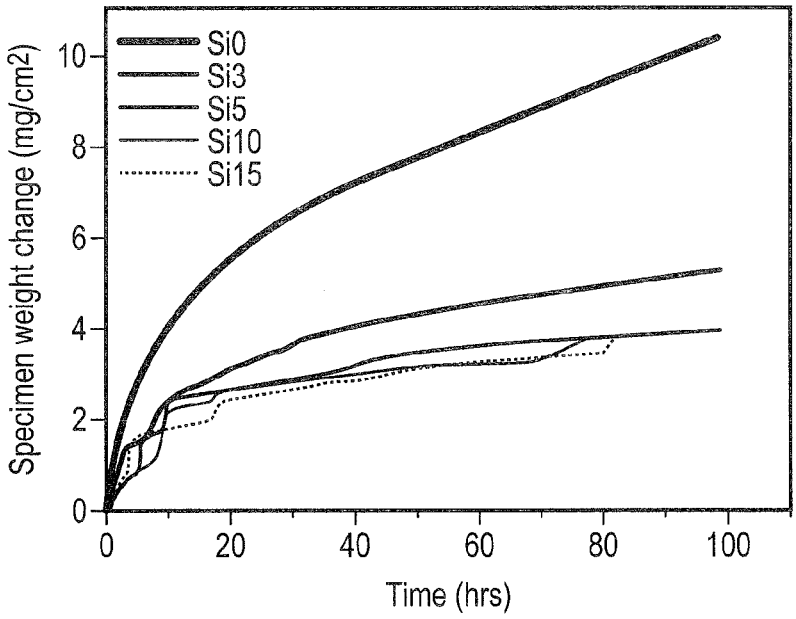
FIG. 5 is a graph showing the oxidation kinetic curves for five chromium alloys.

The isothermal oxidation characteristics of the chromium alloys were evaluated at 1100° C. for 100 hours. In particular the weight change per unit area of the chromium alloys Si3, Si5, Si10 and Si15 are shown in FIG. 5. The data obtained for a binary chromium 10 at % tantalum alloy is also shown as Si0. These results show a decrease in the weight gain, by more than a factor of two, between the binary alloy Si0 and the alloys Si5, Si10 and Si15. It is seen that the final weight gain for alloy Si0 is 10.4 mg/cm$^2$, the final weight gain for alloy Si3 is 5.3 mg/cm$^2$ and the final weight gain reduces for alloys Si5, Si10 and Si15 to about 3.8 to 4.0 mg/cm$^2$ and the weight gain does not vary significantly between alloys Si5, Si10 and Si15, i.e. with variations of silicon between 5 at % and 15 at %. This shows that silicon addition is beneficial, increases oxidation resistance, for this class of refractory metal Laves phase chromium alloy, e.g. a chromium alloy containing $Cr_2Ta$ Laves phase. This also shows that silicon additions of more than 5 at % do not provide any further significant increase in oxidation resistance for these chromium alloys at 1100° C. after 100 hours exposure.

It is believed that the oxidation resistance of the chromium alloys of the present invention may be increased by adding up to 10 at % of each one or more of the elements titanium, zirconium, hafnium, vanadium, palladium, lanthanum, cerium, yttrium and rhenium.

The hypereutectic chromium alloy of the present invention comprises a microstructure consisting predominantly of a Cr (Ta) solid solution and a $Cr_2Ta$ Laves phase consisting of 9 to 12 at % tantalum, 4 to 15 at % silicon, 0 to 7 at % molybdenum, 0 to 7 at % aluminium, 0 to 7 at % titanium, 0 to 5 at % rhenium, 0 to 2 at % silver, 0 to 2 at % hafnium, 0 to 2 at % lanthanum, 0 to 2 at % cerium, 0 to 2 at % yttrium and the balance chromium and incidental impurities.

The following information justifies the rationale for using particular elemental additions:—

Chromium is used as the base element of the alloy system and the chromium rich matrix provides a toughening phase. The $Cr_2Ta$ rich Laves phase provides reinforcement of the chromium phase matrix. Chromium is inherently oxidation and corrosion resistant.

Tantalum promotes the formation of the $Cr_2Ta$ rich Laves phase with the chromium and the $Cr_2Ta$ rich Laves phase imparts high temperature strength and environmental resistance. The eutectic for chromium and tantalum occurs at about 9.6 at % tantalum. Suitable hypereutectic chromium alloys may be obtained with tantalum additions up to about 12 at % tantalum. Alloying may also reduce the eutectic composition, and therefore a lower limit of 9 at % tantalum may also produce a hypereutectic chromium alloy.

Silicon segregates to the $Cr_2Ta$ rich Laves phase and improves both the fracture toughness and the oxidation resistance of the chromium alloy. The most beneficial range of addition of silicon is 5 at % to 15 at %, but may have a lower limit of 4 at %.

Molybdenum provides solid solution strengthening of the chromium phase, but molybdenum has limited solid solubility in chromium and therefore molybdenum addition is limited to the range of 0 to 7 at %.

Aluminium provides solid solution strengthening of the chromium phase and may also provide beneficial effects on the oxidation resistance of the chromium alloy. High levels of aluminium are detrimental to fracture toughness and therefore aluminium addition is in the range 0 to 7 at %.

Titanium may improve properties through interstitial gettering. However, titanium has limited solubility in chromium and therefore additions are in the range 0 to 5 at %.

Rhenium may improve the ductility of the chromium alloy and provide solid solution strengthening. However, the high cost of rhenium and its density restrict the level of additions that can be made and therefore the addition is in the range 0 to 5 at %.

Silver is known to improve the ductility of the chromium rich phase, but the greatest benefits are achieved with low levels of addition of 0 to 2 at %.

Hafnium may enhance high temperature environmental resistance, but may reduce the toughness of the chromium alloy at higher levels, therefore addition is in the range 0 to 2 at %.

Lanthanum, cerium and yttrium are trace additions to help in providing superior oxidation resistance by means of reactive element effect and provide enhanced protection from nitrogen embrittlement. The addition of each these elements is 0 to 2 at %.

A particular chromium alloy, alloy Si5, consists of 9.4 at % tantalum, 4.7 at % silicon and the balance chromium and incidental impurities. Another particular chromium alloy, alloy Si7, consists of 9.1 at % tantalum, 6.3 at % silicon and the balance chromium and incidental impurities. Another chromium alloy, alloy Si10, consists of 10.6 at % tantalum, 9.8 at % silicon and the balance chromium and incidental impurities. A further chromium alloy consists of 9.1 at % tantalum, 12.7 at % silicon and the balance chromium and incidental impurities. Another chromium alloy, alloy Si3, consists of 9.7 at % tantalum, 4.9 at % silicon and the balance chromium and incidental impurities.

The compositions of a further series of chromium alloys according to the present invention are listed in Table 4.

TABLE 4

| | Element at % | | | | | | | | | | | |
|---|---|---|---|---|---|---|---|---|---|---|---|---|
| Alloy | Cr | Ta | Si | Mo | Al | Ti | Re | Ag | Hf | La | Ce | Y |
| 1 | 80 | 10 | 7 | 3 | | | | | | | | |
| 2 | 80 | 10 | 7 | | 3 | | | | | | | |
| 3 | 78 | 10 | 7 | | | 5 | | | | | | |
| 4 | 80 | 10 | 7 | | | | 3 | | | | | |
| 5 | 82.5 | 10 | 7 | | | | | 0.5 | | | | |
| 6 | 82 | 10 | 7 | | | | | | 1 | | | |
| 7 | 82.5 | 10 | 7 | | | | | | | | | 0.5 |
| 8 | 77.5 | 10 | 7 | | | 5 | | | | | | 0.5 |
| 9 | 77 | 10 | 7 | | | 5 | | 0.5 | | | | 0.5 |
| 10 | 71 | 10 | 7 | 3 | 3 | 5 | | 0.5 | | | | 0.5 |
| 11 | 70 | 10 | 7 | 3 | 3 | 5 | | 0.5 | 1 | | | 0.5 |

The present invention provides a hypereutectic chromium alloy consisting predominantly of a chromium rich solid solution and an intermetallic Laves phase based on $Cr_2Ta$, which is suitable for use in high temperature applications. The addition of silicon, in the amounts quoted, to this hypereutectic chromium alloy provides improved oxidation resistance at high temperatures and improved fracture toughness at room temperatures and it is believed to have superior hot corrosion resistance.

The chromium alloys of the present invention may be cast and may be directionally solidified to produce preferential, directional, alignment of the Laves phase for applications in which the resistance to directional loading is required, e.g. turbine blades. During the directional solidification the molten chromium alloy is poured into a mould within a heated vacuum furnace and the mould rests on a cooled chill plate. The mould and cooled chill plate are withdrawn from the heated vacuum furnace so that the chromium alloy initially solidifies adjacent to the cooled chill plate and gradually solidifies along the length of the mould as more of the mould is withdrawn from the heated vacuum furnace.

The broad, intermediate and preferred composition ranges of chromium alloys according to the present invention are listed in Table 5.

| Element at % | Broad | Intermediate | Preferred |
|---|---|---|---|
| Cr | Bal | Bal | Bal |
| Ta | 9 to 12 | 9 to 11 | 9 to 11 |
| Si | 4 to 15 | 5 to 12 | 5 to 10 |
| Mo | 0 to 7 | 0 to 5 | 0 to 5 |
| Al | 0 to 7 | 0 to 5 | 0 to 5 |
| Ti | 0 to 7 | 0 to 5 | 0 to 5 |
| Re | 0 to 5 | 0 to 3 | 0 to 1 |
| Ag | 0 to 2 | 0 to 1 | 0 to 1 |
| Hf | 0 to 2 | 0 to 2 | 0 to 1 |
| La | 0 to 2 | 0 to 1 | 0 to 1 |
| Ce | 0 to 2 | 0 to 1 | 0 to 1 |
| Y | 0 to 2 | 0 to 1 | 0.1 to 1 |

Although the chromium alloy of the present invention has been described with reference to use as an intermediate pressure turbine blade, an intermediate pressure turbine vane, an intermediate pressure turbine seal segment, an intermediate pressure turbine shroud or a combustion chamber tile of a gas turbine engine, the chromium alloy of the present invention may also be used as a low pressure turbine blade, a low pressure turbine vane, a low pressure turbine seal segment, a low pressure turbine shroud, a high pressure turbine blade, a high pressure turbine vane, a high pressure turbine seal segment, a high pressure turbine shroud of a gas turbine engine, a gas turbine engine exhaust nozzle segment, a steam turbine component, a thruster nozzle or a rocket component.

The invention claimed is:

1. A hypereutectic chromium alloy consisting of 9 to 12 at % tantalum, 4 to 15 at % silicon, 0 to 7 at % molybdenum, 0 to 7 at % aluminium, 0 to 7 at % titanium, 0 to 5 at % rhenium, 0 to 2 at % silver, 0 to 2 at % hafnium, 0 to 2 at % lanthanum, 0 to 2 at % cerium, 0 to 2 at % yttrium and the balance chromium and incidental impurities.

2. A chromium alloy as claimed in claim 1 consisting of 9 to 11 at % tantalum.

3. A chromium alloy as claimed in claim 1 consisting of 5 to 12 at % silicon.

4. A chromium alloy as claimed in claim 1 consisting 0 to 3 at % rhenium.

5. A chromium alloy as claimed in claim 1 consisting of 0 to 1 at % silver.

6. A chromium alloy as claimed in claim 1 consisting of 0 to 5 at % molybdenum, 0 to 5 at % aluminium and 0 to 5 at % titanium.

7. A chromium alloy as claimed in claim 1 consisting of 5 to 10 at % silicon.

8. A chromium alloy as claimed in claim 1 consisting of 0 to 1 at % rhenium.

9. A chromium alloy as claimed in claim 1 consisting of 0 to 1 at % hafnium.

10. A chromium alloy as claimed in claim 1 consisting of 0 to 1 at % lanthanum, 0 to 1 at % cerium and 0 to 1 at % yttrium.

11. A chromium alloy as claimed in claim 10 consisting of 0.1 to 1 at % lanthanum, 0 to 1 at % cerium and 0 to 1 at % yttrium.

12. A chromium alloy as claimed in claim 1 consisting of 1 to 6 at % molybdenum.

13. A chromium alloy as claimed in claim 1 consisting of 1 to 6 at % aluminium.

14. A chromium alloy as claimed in claim 1 consisting of 1 to 6 at % titanium.

15. A chromium alloy as claimed in claim 1 consisting of 1 to 5 at % rhenium.

16. A chromium alloy as claimed in claim 1 consisting of 0.1 to 1 at % silver.

17. A chromium alloy as claimed in claim 1 consisting of 0.1 to 1.5 at % hafnium.

18. A chromium alloy as claimed in claim 1 consisting of 0.1 to 1.5 at % yttrium.

19. A chromium alloy as claimed in claim 1 comprising a Cr (Ta) solid solution and a $Cr_2Ta$ Laves phase.

20. A chromium alloy as claimed in claim 19 comprising a $Cr_3Si$ phase.

21. A chromium alloy as claimed in claim 19 wherein the $Cr_2Ta$ Laves phase is directionally aligned to resist directional loading.

22. A hypereutectic chromium alloy consisting of 9 to 11 at % tantalum, 5 to 12 at % silicon, 0 to 5 at % molybdenum, 0 to 5 at % aluminium, 0 to 5 at % titanium, 0 to 3 at % rhenium, 0 to 1 at % silver, 0 to 2 at % hafnium, 0 to 1 at % lanthanum, 0 to 1 at % cerium, 0 to 1 at % yttrium and the balance chromium and incidental impurities.

23. A hypereutectic chromium alloy consisting of 9 to 11 at % tantalum, to 10 at % silicon, 0 to 5 at % molybdenum, 0 to 5 at % aluminium, 0 to 5 at % titanium, 0 to 1 at % rhenium, 0 to 1 at % silver, 0 to 1 at % hafnium, 0 to 1 at % lanthanum, 0 to 1 at % cerium, 0.1 to 1 at % yttrium and the balance chromium and incidental impurities.

24. A gas turbine engine component comprising a hypereutectic chromium alloy consisting of 9 to 12 at % tantalum, 4 to 15 at % silicon, 0 to 7 at % molybdenum, 0 to 7 at % aluminium, 0 to 7 at % titanium, 0 to 5 at % rhenium, 0 to 2 at % silver, 0 to 2 at % hafnium, 0 to 2 at % lanthanum, 0 to 2 at % cerium, 0 to 2 at % yttrium and the balance chromium and incidental impurities.

25. A gas turbine engine component as claimed in claim 24 wherein the component is selected from the group consisting of a turbine blade, a turbine vane, a turbine seal segment, a turbine shroud, a combustion chamber liner, a combustion chamber tile and an exhaust nozzle segment.

26. A gas turbine engine component comprising a hypereutectic chromium alloy consisting of 9 to 12 at % tantalum, 4 to 15 at % silicon, 0 to 7 at % molybdenum, 0 to 7 at % aluminium, 0 to 7 at % titanium, 0 to 5 at % rhenium, 0 to 2 at % silver, 0 to 2 at % hafnium, 0 to 2 at % lanthanum, 0 to 2 at % cerium, 0 to 2 at % yttrium and the balance chromium and incidental impurities;

wherein the component is selected from the group consisting of a turbine blade, a turbine vane, a turbine seal segment, a turbine shroud, a combustion chamber liner, a combustion chamber tile and an exhaust nozzle segment;

and the component is a casting of the chromium alloy.

27. A gas turbine engine component as claimed in claim 26 wherein the component is a directionally solidified casting.

* * * * *